United States Patent [19]

Froidevaux

[11] 4,201,077

[45] May 6, 1980

[54] METHOD FOR MEASURING THE RATE OR THE FREQUENCY ERROR OF A QUARTZ TIMEPIECE AND MEASURING APPARATUS FOR CARRYING OUT THIS METHOD

[75] Inventor: Jacques Froidevaux, La Chaux-de-Fonds, Switzerland

[73] Assignee: Electronic Time Company ETIC S.A., La Chaux-de-Fonds, Switzerland

[21] Appl. No.: 949,993

[22] Filed: Oct. 10, 1978

[30] Foreign Application Priority Data

Oct. 10, 1977 [CH] Switzerland ..... 12339/77

[51] Int. Cl.[2] ..... G04D 7/12

[52] U.S. Cl. ..... 73/6; 324/82

[58] Field of Search ..... 73/6; 324/56, 78 F, 324/82

[56] References Cited

U.S. PATENT DOCUMENTS 2,243,702 5/1941 Hansell ..... 324/82

3,892,124 7/1975 Reese ..... 73/6

4,041,767 8/1977 Keeler ..... 324/82

*Primary Examiner*—S. Clement Swisher

*Attorney, Agent, or Firm*—Silverman, Cass & Singer, Ltd.

[57] ABSTRACT

A method and apparatus for measuring the frequency error of a timebase frequency of a quartz timepiece, relative to a reference frequency. An input signal having a frequency equal to the timepiece timebase frequency is produced from the timepiece. The input signal is applied to a passive quartz crystal filter having a resonant frequency equal to the reference frequency, and which filter produces an output signal in response to the input signal. The phase of the input signal and the output of the passive quartz crystal filter is compared and at least one phase comparison signal related to the phase difference of the two signals is produced. The phase comparison signal drives a meter having a dial graduated in frequency error units to display the frequency error.

10 Claims, 12 Drawing Figures

METHOD FOR MEASURING THE RATE OR THE FREQUENCY ERROR OF A QUARTZ TIMEPIECE AND MEASURING APPARATUS FOR CARRYING OUT THIS METHOD

The present invention relates to a method for measuring the rate or the frequency error of a quartz timepiece and a measuring apparatus for carrying out this method.

The term rate is here understood to be used in its sense known in the watchmaking trade, where it means frequency error of an timepiece. More precisely, the rate of such an instrument is the deviation between the correct time and the time indication of the timepiece in an interval of time of twenty-four hours.

Electronic timepieces and more particularly those using a quartz resonator require, for the measurement of their rate, means which are different from those of mechanical timepieces.

It is obviously possible to pick up galvanically the electric signal of the oscillator of such a timepiece, to amplify it and to inject it into a frequency-meter, but this method gives rise to several difficulties which render it difficult to be used:

- the very low levels of power with which quartz watches work have as a consequence that the measurement itself may to modify the frequency
- the points where this frequency have to be picked up are often inaccessible and
- the watchmakers having to effect the checking or measurement and the adjustment do not have in hand the equipment which is necessary to carry out such measurements.

This is the reason for which there have been placed on the market some apparatuses provided with a sensing device scanning the oscillations of the resonator either acoustically or electro-magnetically. The result of the measurement, that is to say the frequency error, or still the rate, is displayed, more often in a digital form, in seconds per day.

Consequently, these apparatuses are conceived or designed on the basis of a frequency-meter making the comparison between the picked up signal and a reference oscillator, and making the conversion from the frequency error to the rate in seconds per day.

The main drawback of this type of apparatus is it complexity and, consequently, its price.

The present invention has for its purpose to furnish a measurement means of the rate of electronic timepieces making use of a measuring system which is very simple, which requires no adjustments by the user, and very which is cheap.

The method of measuring according to the invention includes using the central or resonant frequency of a quartz passive filter as a reference frequency, making a phase comparison of the output signal of the quartz filter and an input signal furnished by the timepiece, and applying to a reading instrument graduated in units of rate or in frequency error the voltage or the current resulting from the phase comparison.

The measuring apparatus according to the invention comprises a quartz passive filter furnishing a reference frequency, at least a sensor picking up an input signal from a timepiece the rate or the frequency error of which is to be measured, a circuit able to effect a phase comparison of the output signal of the quartz passive filter with the input signal and a reading instrument graduated in units of rate or in frequency error to which is applied the voltage or the current furnished by the phase comparison circuit.

The drawing shows, by way of example, one embodiment of the invention.

FIG. 1 is a block-diagram indicating the principle of the measurement.

FIG. 2*a* is a simplified diagram of the measuring circuit.

FIG. 2*b* represents the electrical equivalent of the quartz crystal.

FIG. 2*c* represents the electrical equivalent of the bridge circuit.

Figure 7:
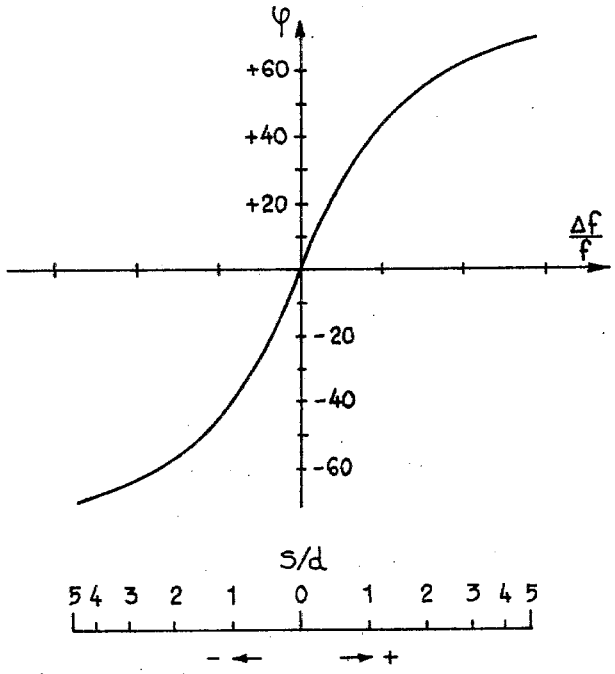
Figure 8A:
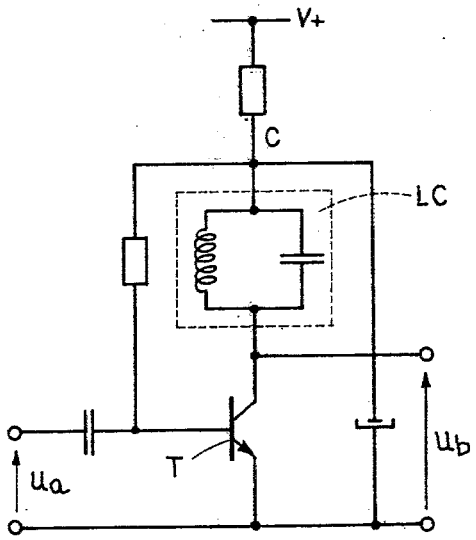
Figure 8B:
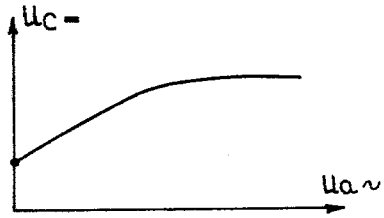
Figure 8C:
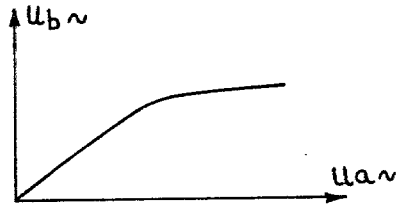

FIG. 7 indicates the graduation of the reading instrument of the measuring apparatus, and FIG. 8*a* is a diagram of another embodiment of the invention FIGS. 8*b* and 8*c* show the response of parts of the circuit of FIG. 8*a*

The present invention is based on the fact that the frequency of a quartz timepiece varies, practically, only a very little, the range of adjustment being at most a few seconds per day. Consequently, one can limit the measurement to a range of some tenths of millionths either side of a nominal frequency.

Figure 1:
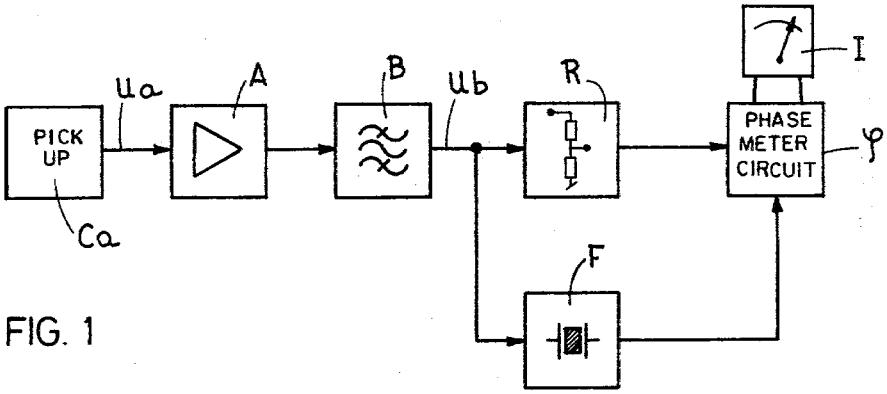

FIG. 1 shows the principle of the measurement. An input signal Ua is picked up on the timepiece to be measured by means of a piezo-electric pick up Ca which may be either inductive or capacitive. The input signal is first amplified by a circuit A the band pass of which is limited to the vicinity of the frequency to be measured by a band pass filter B, so as to eliminate disturbing, parasitic or erroneous signals. The signal is then feed into a resistive attenuator R and into a quartz filter F, both of which constitute a bridge the outputs of which are out of phase relative to each other when the frequency of the input signal differs from the central or resonant frequency $f_o$ of the filter F.

A phasemeter circuit $\phi$ converts the phase deviation into a current or a voltage which is transmitted to a reading instrument I.

Figure 2A:
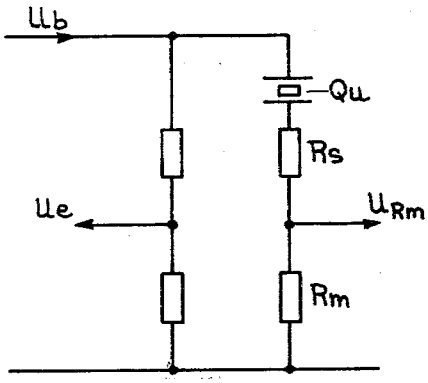
Figure 2B:
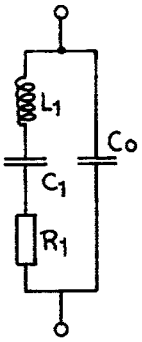
Figure 2C:
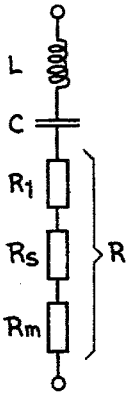

The phase bridge constituted by the attenuator R and the filter F is represented in FIG. 2*a*. The quartz crystal Qu, the equivalent diagram of which is given in FIG. 2*b*, works very close to its series resonance frequency. In a first approximation one can neglect the static capacity $C_o$ so that one need consider only the series branch constituted by a resistance $R_1$, a capacitance $C_1$ and an inductance $L_1$. One sees that, in the phase-angle bridge, the quartz crystal Qu is in series with a resistance $R_s$, which allows one to adjust the band width of the filter, and a measuring resistance $R_m$, at the terminals of which is picked up the output signal. This branch of the bridge is represented in FIG. 2*c*. The sum of the resistances $R_l$, $R_s$ and $R_m$ is called hereinafter R.

The circuit of FIG. 2*c* has an impedance given by the following formula:

$$Z = R + j(\omega L - \frac{1}{\omega C}) \quad (1)$$

At resonance, $\omega L = -1/\omega C$, wherefrom the frequency of resonance is:

$$\omega_o = 1/\sqrt{LC} \quad (2)$$

The factor of quality Q of the whole is defined as being:

$$Q = \omega_o L/R = 1/\omega_o RC \quad (3)$$

Consequently, one can calculate the magnitude and the phase of Z:

$$\bar{Z} = \sqrt{R^2 + (\omega L - \frac{1}{\omega C})^2} \quad (4)$$

and $$\tan\varphi = \frac{\omega L}{R} - \frac{1}{\omega RC} \quad (5)$$

Equation (3) allows one to write:

$$\omega L = QR(\omega/\omega_o) \text{ and } 1/\omega C = QR(\omega_o/\omega)$$

wherefrom:

$$\bar{Z}^2 = R^2\left[1 + Q^2(\frac{\omega}{\omega_o} - \frac{\omega_o}{\omega})^2\right]$$

and $$\tan\varphi = Q(\frac{\omega}{\omega_o} - \frac{\omega_o}{\omega})$$

By stating $\Delta\omega = \omega - \omega_o$ and, by ascertaining that $\Delta\omega << \omega$, this last expression becomes:

$$\tan\varphi = 2Q(\Delta\omega/\omega) \quad (6)$$

and $$\bar{Z}^2 = R^2(1 + \tan^2\varphi) \quad (7)$$

It is favorable that the signal on $R_m$ does not vary too much in the range of the measurement. Moreover, the presence of a parallel resonance due to $C_o$ makes the response curve of the quartz crystal becomes asymmetric when $\varphi$ is in the vicinity of 90°. It is consequently necessary to limit $\varphi$ to a range of 30° to 60°.

In series resonance, $\varphi = 0$, wherefrom $\tan\phi = 0$. Hence Z=R.

When $\varphi = 45°$, $\tan\varphi = 1$ and $\bar{Z} = R\sqrt{2}$

When $\varphi = 60°$, $\tan\phi = \sqrt{3}$ and $\bar{Z} = 2R$

Figure 3:
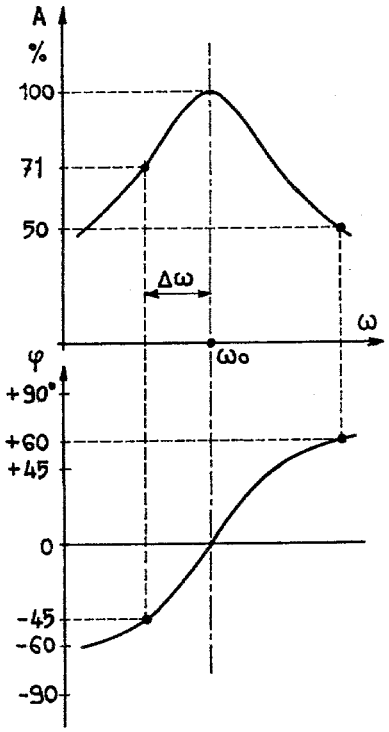
FIG. 3 illustrates the variation of amplitude and of phase which occurs in the vicinity of the resonant frequency of a quartz crystal.

The variation of amplitude and of phase of the signal on $R_m$ is indicated in FIG. 3.

By way of example, it will be considered a practical case with a quartz crystal Qu in which $f_o = 32{,}768$ Hz, $Q = 100{,}000$ and $C_1 = 4 \cdot 10^{-15}$ F.

A scale of reading of ±5 seconds/day for a phase difference of ±45° is choosen.

From the parameters of the quartz crystal is found $R_1 = 12{,}1$ kΩ

The frequence range is $$\Delta\omega/\omega = 5/86{,}400 = 57.87 \cdot 10^{-6}$$

Equation (6) allows one to calculate the global factor of quality desired:

$$Q = \frac{\tan\varphi}{2\frac{\Delta\omega}{\omega}} = \frac{10^6}{2 \cdot 57.87} = 8640$$

wherefrom:

$$R = 1/\omega QC = 140.5 \text{ k}\Omega$$

Consequently, one must choose $R_m = R_s = R - R_1 = 128.4$ kΩ

With these values, the amplitude varies less than 30% in the measuring range.

Figure 4:
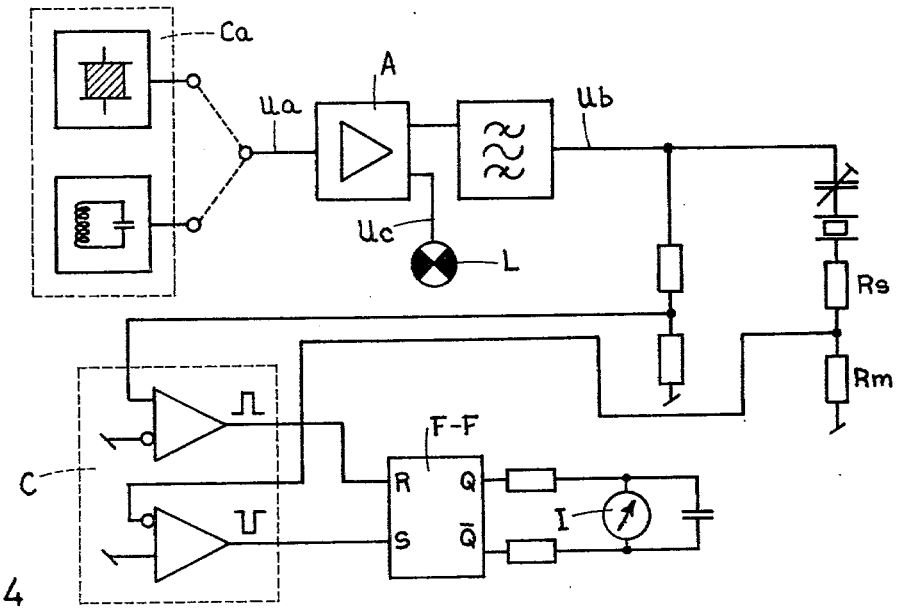
FIG. 4 is a diagram of the whole embodiment of the measuring apparatus.
Figures 5, 6:
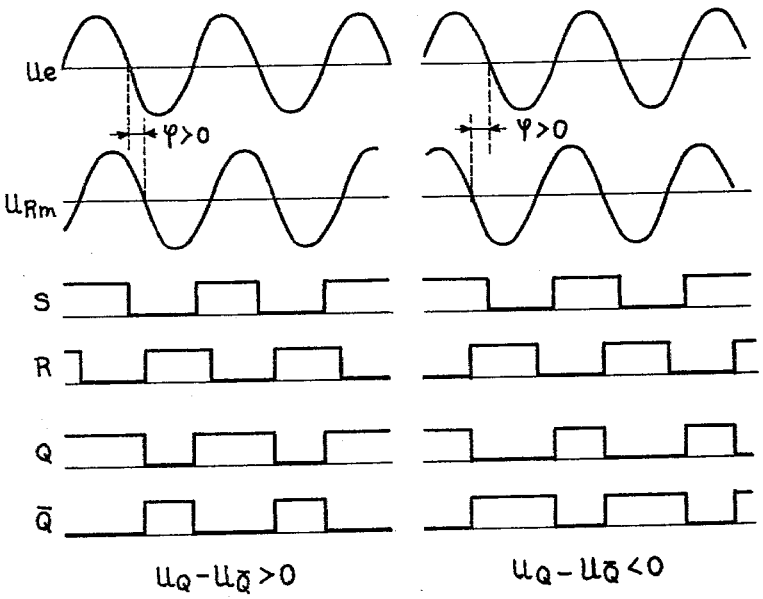
FIG. 5 shows the signals obtained when the frequency to be measured is too high.
FIG. 6 shows the signals obtained when the frequency to be measured is too low.

As shown in FIG. 4, which illustrates in a more detailed diagram one possible embodiment of the present apparatus, the signals coming from the phase-angle bridge are shaped into a rectangular voltage signal at C and applies to the inputs "set" and "reset" of a flip-flop F-F. One of the two signals is reversed or inverted so that the cyclic ratio or duty cycle of the output signal of the flip-flop is 0.5 when $\varphi = 0$. Under these conditions, a measuring instrument I placed between the direct and inverted outputs of the flip-flop indicates zero. If the frequency of the input signal is too high, one obtains the signals represented in FIG. 5, while, if the input frequency is too low, the signals take the appearance as represented in FIG. 6.

Practically, a small variable capacity (trimmer) is connected in series with the quartz crystal for allowing adjustment of the reference frequency.

With respect to systems of measuring using a comparison oscillator, the present apparatus is passive and the quartz crystal oscillates only during the measurement, which is favorable for slow aging and good stability over a long term. Moreover, the present apparatus is very simple and not expensive.

It is to be noted, while referring to equation (6), that the deviation of the apparatus is not linear as a function of the deviation of frequency, but is a function of the arctangent . Hence, the graduation of the apparatus, represented in FIG. 7, is spread out in the vicinity of zero, which is favorable to the precise adjustment of the timepieces to be checked.

For simplifying the use of the apparatus, the amplifier transmitting the signal of the sensor to the phase-angle bridge comprises at least a clipper for clipping off the tops of the pulses, the circuit of which is represented in FIG. 8*a*. The clipper is provided with an LC filter and is polarized in such a way that the collector voltage of a transistor T comes close to the transistor saturation voltage. When a sufficiently large signal is applied to the input of this stage, the diode constituted by the base-emitter junction of the transistor acts as a rectifier, wherefrom a polarization in blocking off of the transistor and a progressive elevation of the continuous voltage at the collector takes place. The continuous voltage picked up at point C is used for lighting a signal-lamp L (FIG. 4) indicating that the measuring level is sufficient.

The evolution of the voltage at point C as a function of the input signal Ua is represented at 8*b* while 8*c* shows the variation of the amplified signal Ub as a function of the input amplitude. The comparison of the two curves shows the limitations of such a stage.

Modifications can be made to the circuit of FIG. 4 for obtaining some particular performances. Especially, the checking of analog timepieces having a step by step motor can present some difficulties, the driving pulses of the motor seriously disturbing the oscillator signal. In this case, one can introduce a phase locked loop (PLL) into the amplifier for improving the rejection of the parasitic signals.

The use of the present apparatus is not restricted to the measurement of the rate of watches, but can be extended to the checking or measurement of any timepiece having a quartz time base, such as small clocks, electronic switch-clocks, etc.

However, there are several frequencies at which these timepieces work, for instance 32,768 Hz, 786,432 Hz, 4,194,304 Hz, etc. Consequently, it is favorable to include into the present apparatus several switchable quartz filters, each being constituted by a quartz crystal, a trimmer and a suitable resistance $R_S$.

However, the comparison of phase at high frequencies can give rise to some problems, and it can be preferable to be able to connect to the input of the apparatus several sensors each containing a frequency converter converting any signal back to the selected frequency of the filter.

For instance, if the filter is provided for the frequency of 32,768 Hz, the sensor for the frequency of 786,432 Hz will contain a divider dividing by 24, while the sensor for the frequency of 4,194,304 will be provided with a divider dividing by 128.

The fact of having at one's disposal interchangeable sensors allows one also to adapt the apparatus to the type of detection which is the most favorable. As a matter of fact, piezo-electric detection is very convenient for allowing control of watches without having to open their casing, while the control by detection of an electromagnetic signal is preferable for the adjustment of open modules, since such detection is not sensitive to the noises produced by the manipulation of the adjustment.

What I claim is:

1. Method of measuring the frequency error of a timebase frequency signal of a quartz crystal timepiece relative to a reference frequency comprising:

producing an input signal from the timepiece having a frequency equal to the timebase frequency signal, applying the input signal to a passive quartz crystal filter having a resonant frequency equal to the reference frequency, producing at least one phase comparison signal corresponding to the phase difference between the input signal and an output signal of the passive quartz crystal filter produced in response to the input signal being applied thereto, and displaying said frequency error in response to said phase comparison signal on a meter including a dial graduated in units of frequency error.

2. The method as claimed in claim 1 in which displaying the frequency error includes displaying the frequency error on a meter including a dial having a center position indicating zero frequency error and a graduation of frequency error which is arranged in an arctangent function on either side of the center position.

3. Apparatus for measuring the frequency error of a timebase frequency signal of a quartz crystal timepiece relative to a reference frequency comprising:

sensor means for producing from said timepiece an input signal having a frequency equal to the timebase frequency signal, passive quartz crystal filter means coupled to said input signal for providing a reference frequency, the filter means having a resonant frequency equal to said reference frequency, and producing an output signal in response to said input signal, comparator means for producing at least one phase comparison signal corresponding to the phase difference between the input signal and the output signal of the filter means, and display means for displaying the frequency error of the timepiece in response to the phase comparison signal on a dial graduated in units of frequency error.

4. Apparatus as claimed in claim 3 in which the display means dial includes a center position indicating zero frequency error and a graduation of frequency error which is arranged in an arctangent function on either side of the center position.

5. Apparatus as claimed in claim 3 in which there is input amplifier means for amplifying the input signal from the sensor means.

6. Apparatus as claimed in claim 5 in which the input amplifier means includes clipper means for providing a direct current signal related to the amplitude of the input signal, and in which there is indicator means for indicating whether the amplitude of the input signal is sufficient to operate the apparatus in response to said direct current signal.

7. Apparatus as claimed in claim 5 in which the input amplifier means includes at least one stage including phase locked loop means for improving the rejection of parasitic signals of the input signal.

8. Apparatus as claimed in claim 3 in which there are a plurality of sensor means with each sensor means operating as a piezoelectric detector, and each sensor means operating in one of an inductive or capacitive mode.

9. Apparatus as claimed in claim 3 in which there are a plurality of sensor means with each sensor means sensing substantially one frequency, and each sensor means including frequency converter means for converting the substantially one frequency sensed to substantially the resonant frequency of the passive quartz crystal filter means.

10. Apparatus as claimed in claim 3 in which the comparator means includes logic means for shaping the input signal into a first square wave signal in phase with the input signal, invertor logic means for shaping the output signal of the passive quartz crystal filter means into a second square wave signal inverted in phase with the output signal of the passive quartz crystal filter means and flip-flop means for producing the at least one phase comparison signal in response to the first and second square wave signals, the phase comparison signal having a 50% duty cycle when the timebase frequency of the timepiece equals the reference frequency.

* * * * *